United States Patent [19]

Boothe

[11] Patent Number: 4,697,305

[45] Date of Patent: Oct. 6, 1987

[54] RELEASE MECHANISM FOR LOCKING HINGE FOR MULTI-POSITIONED LADDER

[75] Inventor: Lee H. Boothe, American Fork, Utah

[73] Assignee: Harold R. Wing, Springville, Utah

[21] Appl. No.: 934,570

[22] Filed: Nov. 21, 1986

Related U.S. Application Data

[63] Continuation of Ser. No. 701,735, Feb. 14, 1985, abandoned.

[51] Int. Cl.[4] ..... E05D 11/10

[52] U.S. Cl. ..... 16/329; 16/331; 16/344; 16/349; 182/163

[58] Field of Search ..... 16/324, 326, 327, 329, 16/330, 331, 332, 333, 334, 344, 345, 347, 349, 353, 359; 182/22, 23, 26, 163

[56] References Cited

U.S. PATENT DOCUMENTS

| | | | |
|---|---|---|---|
| 470,516 | 3/1892 | Skeels . | |
| 501,406 | 7/1893 | Campbell . | |
| 697,294 | 4/1902 | Totman . | |
| 745,320 | 12/1903 | Bruno . | |
| 796,157 | 8/1905 | Skeels . | |
| 1,461,952 | 7/1923 | Walchli . | |
| 1,633,902 | 6/1927 | Olson et al. . | |
| 1,936,508 | 11/1933 | Hanly et al. | 228/23 |
| 2,210,803 | 8/1940 | Dunn | 228/66 |
| 2,647,676 | 8/1953 | Napiecinski | 228/23 |
| 2,880,920 | 4/1959 | Glessner | 228/21 |
| 3,692,143 | 9/1972 | Kummerlin et al. | 182/24 |
| 3,811,151 | 5/1974 | Kummerlin | 182/163 X |
| 4,182,431 | 1/1980 | Wing | 182/23 |
| 4,210,224 | 7/1980 | Kummerlin et al. | 182/207 |
| 4,216,844 | 8/1980 | Klafs | 16/329 |
| 4,371,055 | 2/1983 | Ashton | 182/46 |
| 4,376,470 | 3/1983 | Ashton | 182/23 |
| 4,403,373 | 9/1983 | Kummerlin | 16/326 X |
| 4,407,045 | 10/1983 | Boothe | 182/163 X |
| 4,566,150 | 1/1986 | Boothe | 16/332 |

FOREIGN PATENT DOCUMENTS

| | | |
|---|---|---|
| 2228045 | 12/1973 | Fed. Rep. of Germany . |
| 30056929 | 2/1980 | Fed. Rep. of Germany . |

*Primary Examiner*—Fred Silverberg

*Attorney, Agent, or Firm*—Workman, Nydegger & Jensen

[57] ABSTRACT

An improved hinge for collapsible ladders which includes a depressable release mechanism operable by one hand, leaving the other hand free to make ladder adjustment. The improved hinge includes a guide shaft disposed within a tubular hub member which is journaled within hinge plates to which the ladder stringers are connected. A handle with locking pins is secured to one end of the guide shaft, with the other end of the guide shaft being secured to a depressable hinge release mechanism.

9 Claims, 5 Drawing Figures

RELEASE MECHANISM FOR LOCKING HINGE FOR MULTI-POSITIONED LADDER

This application is a continuation in part of U.S. application Ser. No. 701,735, filed Feb. 14, 1985, for IMPROVED LOCKING HINGE FOR MULTI-POSITIONED LADDER, now abandoned.

BACKGROUND OF THE INVENTION

1. Field of the Invention

The present invention relates to an improved ladder hinge and locking mechanism, and more particularly to a ladder hinge that has a plurality of locking positions which enable displacement of attached ladder stringers from a closed, storage position, through a step-ladder configuration, to an extended, straight ladder position.

2. Prior Art

In an earlier patent of the same inventor, U.S. Pat. No. 4,407,045, an extensive discussion of the prior art for multi-positioned ladder hinge locking mechanisms was discussed. The present invention constitutes an improvement over the structure which was disclosed in this earlier patent (referred to hereafter as the '045 patent). This patent discloses a rotating and locking mechanism for joining two hinge members rotationally about a common axis. The respective hinge members are mounted on a hub with one of the hinge members being fixed to rotate with the hub, while the remaining member is free to rotate independently of the hub structure. The hub houses a shaft which is oriented along the rotational axis for the hinge and which is co-axial with the longitudinal axis of the hub. A disk is attached at one end of the shaft and a handle with locking pins is positioned at the remaining shaft end. A plurality of locking apertures are diametrically positioned for selective alignment with the locking pins, depending upon the particular position desired for the ladder stringers.

The core opening or aperture for the hub is constructed with two differing inner diameters. The larger inner diameter of the hub is located on the distal side from the handle and locking pins. The lesser diameter is more proximate to the handle and establishes a blocking shoulder to restrain axial movement of the disk as the handle is extended away from the hinge members. The blocking shoulder prevents the locking pins from being fully removed from the outer hinge member, while enabling the inner hinge member to rotate to a new adjustment position. The patent also describes a detent arrangement which enables the handle to lock to a temporary extended position during rotation of the hinge to a new adjustment. The handle and locking pins are biased to an inserted, locking position by a spring which is enclosed within the hub core and between the disk and an opposing wall through which the shaft extends to the handle.

The detent mechanism is required to hold the handle in an extended position because of the awkward coordination of movements associated with moving the ladder configuration while pulling the handle and locking pins free from the rotating hinge members. For example, it is apparent to those skilled in the art that without the detent arrangement which holds the handle in its extended configuration, a person manipulating the ladder must both hold laterally on the handle located at the top of the ladder, while at the same time pushing apart on the legs or stringers which are attached to the hinge. A concurrent opposing force arising during this push-pull sequence creates substantial difficulty for the user in making regular adjustments to ladder positions. Furthermore, the user has limited leverage with respect to the ladder because of the required pulling action in order to release the locking pins from the rotatable hinge. This reduced leverage associated with the pulling movement further adds to the inconvenience of operating the adjustable locking mechanism for the '045 patent. Furthermore, the structural requirement that the biasing spring be placed within the hub severely limits the size of spring which can be applied to the adjustable locking hinge.

In addition to the safety and convenience considerations, it should be noted that the hub structure requires several tooling operations to develop the differing diameters making up the hub core or aperture. In addition, the retaining wall opposite the disk further adds to the increased cost of manufacture and expense of the hub and related structure. Because of the significantly lower cost for ladders which do not use a locking hinge similar to the referenced prior art devices, each aspect of increased cost increases consumer reluctance to purchase an adjustable, locking ladder, despite the many advantages which such a device provides.

OBJECTS AND SUMMARY OF THE INVENTION

It is therefore an object of the present invention to provide an improved locking hinge for collapsable ladders wherein extension of the locking pins is developed by a pushing force, as opposed to the pulling force heretofore applied.

It is a further object of the present invention to provide an adjustable locking hinge which enables the user to apply a pushing force with a single hand, while using the remaining hand to displace the ladder stringers to a new position.

It is a still further object of this invention to enhance the simplicity and ease of adjustment operation, while at the same time providing for an improved structure which offers greater durability and strength within the spring biasing mechanism.

Yet another object of this invention is to develop the improved hinge structure, while at the same time simplifying manufacturing operations to thereby reduce the cost of the end product.

These and other objects are realized in an improved locking hinge for collapsible ladders wherein the hinge is made up of first and second rotating members which are adapted for attachment to ladder stringer structures. The hinge comprises a tubular hub member slightly smaller in diameter than a pivot aperture in head portions of the first and second rotating hinge members. The tubular hub member is positioned within the pivot aperture and includes a locking end and an unlocking end and a longitudinal axis coaxially oriented with the pivot axis. The tubular opening forms a guide aperture also oriented along the longitudinal axis. A guide shaft is disposed within the hub member and is adapted for translation between extended and retracted positions and rotation about the longitudinal axis. A handle is secured to the guide shaft adjacent to the unlocking end of the hub member and includes a locking pin which is positioned for engagement within locking apertures which are alligned at an orientation preselected as an appropriate ladder position.

A push-type hinge release mechanism enables quick and easy release of the locked configuration of the hinge. It includes a release plate which has an operating side having an annular flange projecting towards the hub member. The annular flange is constructed with a cross-sectional configuration characterized by either (i) an inner-tubular diameter which is slightly larger than the outer diameter of the hub member or (ii) an outer diameter which is slightly smaller than the inner diameter of the hub member, to thereby enable the annular flange to telescopically mate with the hub member when the guide shaft is in the partially extended position. The guide shaft and release plate are locked in fixed rotational configuration by means of a locking pin which is inserted through the annular flange and into the guide shaft.

A biasing spring is housed within the enclosed area within the flange and in physical contact with the locking end of the tubular hub member. Accordingly, the biasing load is carried directly at the hub member as opposed to the guide shaft.

The subject invention may be further adapted with axial detent structure to retain the guide shaft in a partially extended position in opposition to the biased force while permitting rotation of the guide shaft within the guide aperture.

BRIEF DESCRIPTION OF THE DRAWINGS

Other objects and features of the present invention will be apparent to those skilled in the art, based upon the following detailed description, taken in combination with the drawings in which.

DETAILED DESCRIPTION OF THE PREFERRED EMBODIMENT

Figure 1:
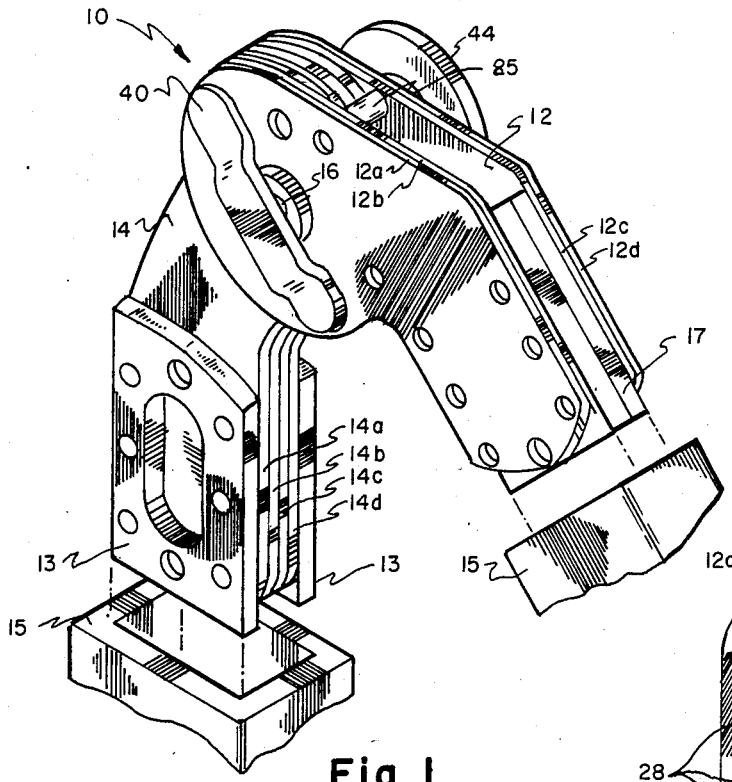
FIG. 1 discloses a perspective view of the subject locking hinge in the retracted position.

FIG. 1 illustrates a hinge 10 and ladder 15 assembly which is made operable by an adjustable locking mechanism 16 which is discussed in detail hereafter. The ladder hinge 10 comprises two sets of interlocking support plates 12 and 14 whose rotation and position are controlled by the locking mechanism 16.

Figure 2:
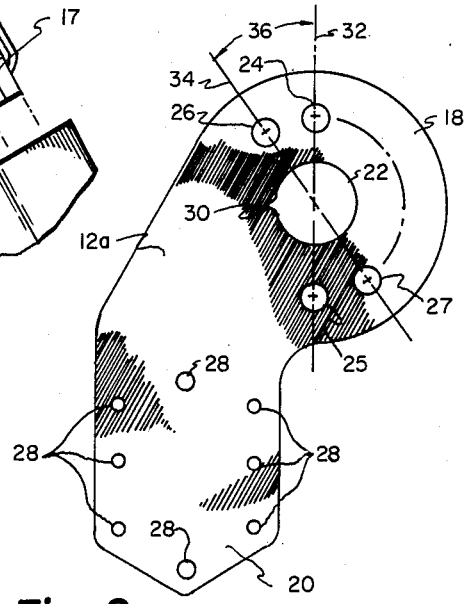
FIG. 2 illustrates one of the hinge members in plan view.

In the preferred embodiment, each set of support plates 12, 14, is made up of four individual support plates 12*a–d* and 14*a–d*, respectively. It will be appreciated, however, that any number of support plates could be used for support plate sets 12 and 14. The configuration of each support plate 12*a–d*, 14*a–d* is identical and will, therefore, be described with reference to plate 12*a*, shown in FIG. 2. Support plate 12*a* has an essentially annular portion 18 and a stringer engaging portion 20 which extends generally tangentially outward from annular portion 18. Support plate 12*a* is provided with a plurality of apertures. Aperture 22 at the center of annular portion 18 is designed for receiving a portion of locking mechanism 16 in mating relationship. Four locking apertures 24–27 are spaced at equal radial distances from aperture 22. Aperture 28 is located in the stringer engaging portion 20 and is utilized to rigidly secure the ladder hinge 10 to the stringer of a ladder. Plate 12*a* is also provided with locating notch 30 in aperture 22 which assures proper orientation of support plate 12*a* a with respect to locking mechanism 16. As further illustrated in FIG. 2, locking apertures 24, 25 lie on the same diametric axis 32 of annular portion 18 on opposite sides of the aperture. Similarly, locking apertures 26, 27 lie on diametric axis 34. Apertures 24–27 are radially spaced apart in the presently preferred embodiment such that the angle 36 between axis 32 and 34 is approximately 35 degrees.

Referring to FIG. 1, plates 12 and 14 engage one another in interlocking relationship. A pair of spacers 17 is interposed between the stringer engaging portion 20 of plates 12*b* and 12*c* so as to provide a space between the annular portion 18 of plates 12*b* and 12*c* for receiving the annular portion of plates 14 therebetween. To reduce wear on plates 12 and 14, replaceable inserts (not shown) are placed between plates 12*b* and 14*a* and between plates 12*c* and 14*d*. Accordingly, the width of spacers 17 should generally correspond to the widths of plates 14*a–d* plus the width necessary for the replaceable inserts. A second pair of spacers 13 is attached to the stringer engaging portion 20 of plates 14*a* and 14*d* so that the stringer engaging portions 20, of both sets of plates 12 and 14, along with spacers 17 and 13 have essentially the same overall dimensions. As further illustrated in FIG. 1, the stringer engaging portions 20 of plates 12, 14 in combination with spacers 17, 13 are dimensionally configured so as to engage tubular stringer portions 15, whereby ladder hinge 10 may be rigidly secured to ladder stringers.

Plates 12 and 14 are rotated relative to one another about aperture 22. As these plates 12, 14 are rotated, it will be appreciated that at least one pair of locking apertures 24–27 of plates 14 come into exact alignment with at least one pair of the locking apertures 24–27 of plates 12 at a plurality of positions which correspond to the various ladder configurations which may be desired. These positions might include a folded position for storage, a step ladder position wherein the stringers are partially separated at an acute angle, or a fully unfolded, extended position wherein the ladder resembles an extension ladder. These various positions are enabled by means of a locking mechanism 16 which controls the rotation and adjustment of the respective hinge plates 12 and 14 and the attached ladder stringers.

Figure 3:
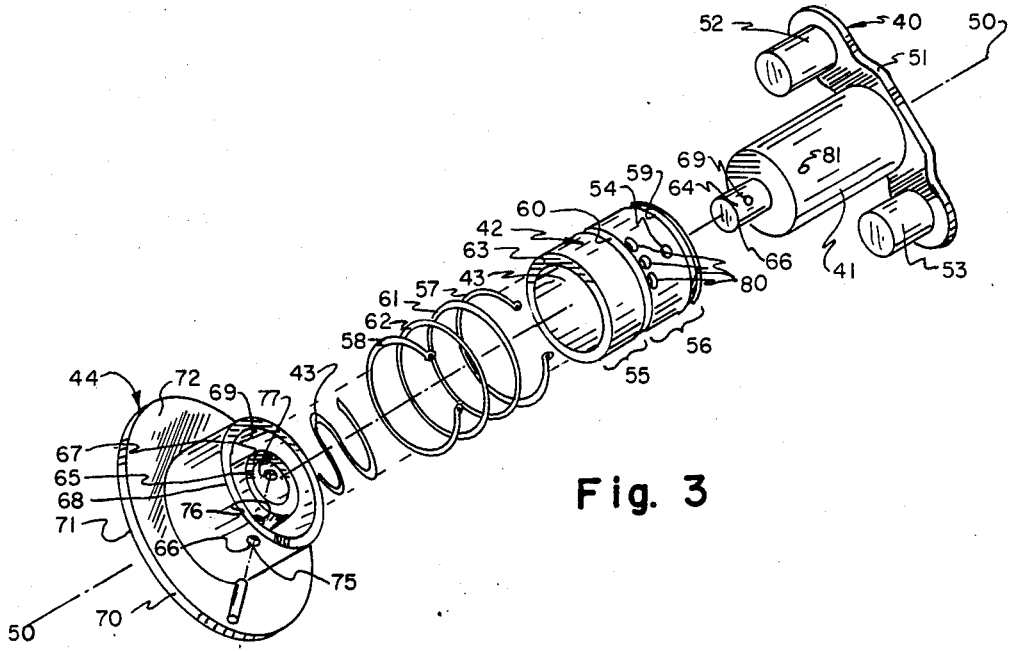
FIG. 3 is an exploded view of the adjustable locking mechanism which controls position of the hinge members.
Figure 5:
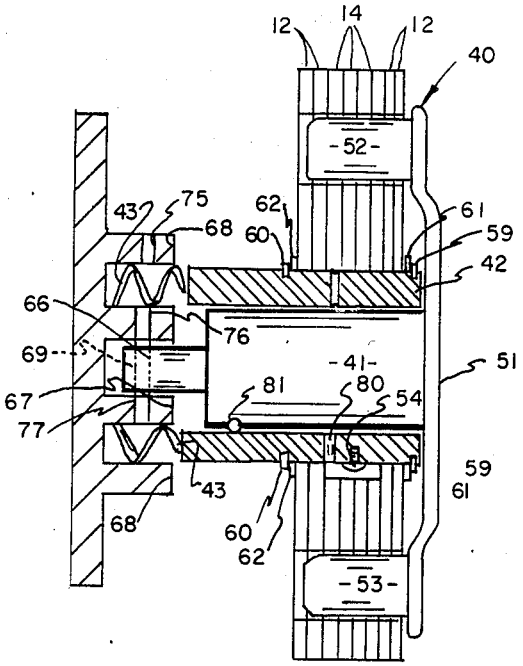
FIG. 5 is a similar cross-sectional view of the structure of FIG. 3, shown in the retracted position.
Figure 4:
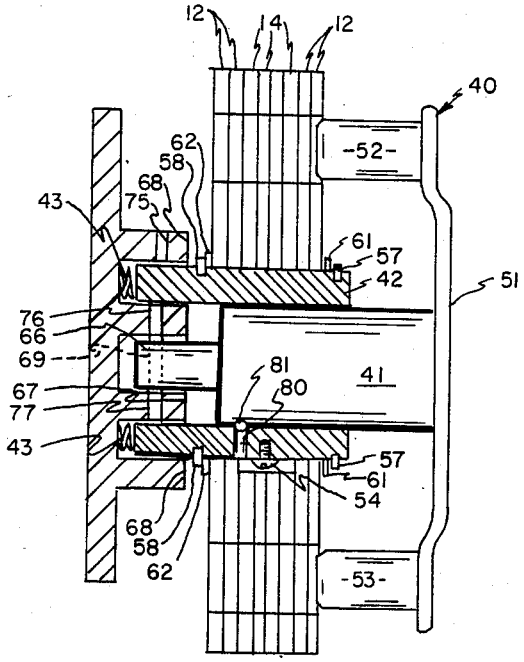
FIG. 4 is a partial cross-sectional view of the hinge locking mechanism of FIG. 3, shown in the extended position.

Referring now to FIGS. 3, 4 and 5, locking mechanism 16 includes a locking handle 40, a guide shaft 41, a central hub 42, a biasing member 43, and a release mechanism 44. These components are interconnected along a common axis 50 in a manner which shall be further described hereafter. This common longitudinal axis 50 also forms the pivotal axis for the hinge 10.

The locking handle 40 is constructed of a suitable grade of steel or other rigid material whose strength satisfies safety requirements for retaining the hinge members 12 and 14 in the desired position, despite heavy loading which may occur through the stringers. A pair of locking pins 52 and 53 are welded in parallel orientation and common projection to the locking handle 51. Hereagain, locking pins 52 and 53 must be capable of withstanding sheer forces which are applied through the hinge plate 12 and 14 as the ladder is loaded. The locking pins 52 and 53 are configured to engage locking apertures 24–27 in mating relationship. The locked or fixed angular position of the hinge members is achieved as the locking pins are inserted through the locking apertures 24–27 of each of the two hinge members and is referred to hereafter as the locked or retracted position. In contrast, when the locking pins 52 and 53 are extended out of the rotational path of hinge member 14, then the hinge is in a released configuration, also referred to herein as the unlocked or extended position.

The locking handle 40 is supported in its proper orientation with respect to the hinge plates 12 and 14 by means of the guide shaft 41 and hub 42. Guide shaft 41 is constructed of a steel rod which is tooled to the appropriate dimensions and welded along its central axis to the locking handle substantially as shown in FIG. 3. The radial dimension of the guide shaft 41 is slightly smaller than the inner radius of the tubular hub 42 in which the guide shaft is journaled. The outer dimension of the tubular hub is slightly smaller in diameter than the pivot aperture 22 in the head portions 18 of the first and second hinge members 12 and 14. The tubular hub is journaled within the aligned pivot apertures as shown in FIG. 1, to provide for relative rotational motion between the respective hinge members 12 and 14. A locating pin 54 is positioned to engage the locating slot 30 in hinge member 14. This pin operates to lock rotational movement of one of the hinge members (in this case 14) in concert with rotational movement of the tubular hub. The second hinge member 12 is therefore free to rotate about the hub 42 and locked hinge member 14 to provide adjustment between the various ladder positions.

To simplify description of the tubular hub with respect to other related connecting structure, FIG. 3 illustrates division of the hub into two (2) parts, a locking end 55 and an unlocking end 56. It can be noted, therefore, that locating pin 54 is approximately in the mid section of the unlocking end 56 of the hub member. This portion of the hub has been identified as the unlocking end in view of the extended or unlocked configuration (see FIG. 4) of the locking pins 52 and 53 when the guide shaft is displaced partially out of the hub, with only the unlocking end of the hub retaining the enclosed guide shaft. When the enclosed end of the guide shaft is translated into its retracted position within the locking end of the hub, then locking pins 52 and 53 are seated within a pair of the locking apertures 24–27. It will therefore be apparent to one skilled in the art that the structural dimensions of the hub may vary, but will preserve the operating concept of the locking verses unlocking ends of the hub member.

The hub is secured within the pivot aperture 22 of the support plates 12 and 14 by means of expandable lock rings 57 and 58 which are seated in grooves 59 and 60. The respective support plate elements 12 and 14 are sandwiched between the lock rings 57 and 58, with gaskets 61 and 62 being positioned between the lock ring and outer face of the hinge plate 12 to prevent adverse wear during rotational movement.

The guide shaft 41 is biased into the retracted position shown in FIG. 5 by a spring 43 which is positioned by the release mechanism 44 against the shoulder 63 of the unlocking end of the tubular hub. The guide shaft 41 includes a second shaft 64 of lesser diameter formed integrally with the guide shaft and along the common longitudinal axis 50 such that when the guide shaft is retracted within the tubular hub, the second shaft 64 extends beyond the shoulder 63 of the locking end 55. This second shaft is adapted for securing within a recess 65 of the release member 44. In the preferred embodiment this is accomplished by insertion of a locking pin 66 through axially projecting flange walls 67 and 68 and into a locking bore 69 within the second shaft 64. In this configuration, the guide shaft is axially locked with the release member 44 such that axially movement of either member requires translation of the other member along access 50. Similarly, the release member 44 is locked in rotational movement with the guide shaft 41 such that rotational movement of either requires corresponding rotational movement of the other connected member about axis 50.

By virtue of its rotationally and axially locked configuration with the guide shaft, the release mechanism becomes the key element in making adjustments between various desired positions for the attached ladder stringers. The hinge release mechanism 44 has four identifiable elements. It includes a release plate 70 which has a contact side 71 and an opposing operating side 72. The dimensions of the release plate include a diameter which exceeds the inner diameter of the tubular hub, and is preferably large enough to provide a large contact surface for placement of the hand, arm or other contacting member of the user's body to depress the release plate toward the hub member. Operation of this depressable release plate is in direct contrast to the pulling force previously required with respect to the locking handle of the '045 patent. A distinct advantage of the release plate configuration is to allow the user to apply his forearm or hand against the contact side 71, releasing the locking mechanism and locking pins 52, 53 to enable rotation of the hinge and attached ladder stringers with his free hand.

At least one annular flange 68 is attached or formed at the operating side 72 of the release plate and projects toward the hub member along longitudinal axis 50. The annular flange 68 has a tubular cross-section which is characterized by either (i) an inner-tubular diameter which is slightly larger than the outer diameter of the hub member or (ii) an outer diameter which is slightly smaller than the inner diameter of the hub member to thereby enable the annular flange to telescopically mate with the unlocking end of the hub member when the guide shaft is in the partially extended position as shown in FIG. 4. The figures illustrate formation of the locking recess 65 by use of a second annular flange 67 which likewise projects co-axially with the first annular flange 68 toward the hub member from the operating side of the plate. Accordingly, the respective first 68 and second 67 flanges form an annular channel 69 which is adapted in size and configuration to house the spring 43 and a portion of the unlocking end 55, which telescopically translates within the annular channel 69.

The release mechanism is attached to the assembled hub and locking handle by inserting the second shaft 64 through spring element 43 and into the locking recess 65 while aligning bore 69 with bore openings 75, 76 and 77 which are radially aligned perpendicular with axis 50. Locking pin 66 is then inserted through outer bore opening 75 and seated within bore openings 76, 69 and 77. The length of locking pin 66 is approximately equal to the outer diameter of the second annular flange 67. In this configuration, the unlocking pin does not block axial translation of the locking end 55 of the hub member into the annular channel 69. Likewise, the helical spring 43 is free to extend and compress without interference from the locking pin 66.

The proposed structure provides numerous advantages over prior art mechanisms such as those shown in the '045 patent. As indicated previously, the use of a depression plate 70 as part of a release mechanism for adjusting the ladder positions simplifies the unlocking and adjustment procedure. Because the user merely needs to push the depression plate 70 against the hinge 10 and attached ladder stringers, at least one hand is left free to make the stringer position adjustments. In many situations, the user will be able to apply forearm pressure to the ladder while using both hands to make ladder adjustments. The locking handle as disclosed in the '045 patent pre-empted this more convenient form of adjustment because both hands were required to pull the handle free from the hinge plates. By developing a release mechanism which involves depression, as opposed to pulling, the user is able to take advantage of a greater number of leverage positions with his body, while at the same time depressing the release mechanism to allow adjustment of the ladder stringers. In fact, pressure on the release plate need only be applied until the respective locking apertures 24–27 are misaligned, at which time the locking pins 52 and 53 merely ride along the surface of the hinge plate 12 or 14 until encountering the next set of aligned locking apertures 24–27. Therefore, the depression of the release mechanism need only be momentary, until the misalignment of the apertures occurs.

Although the disclosed locking structure can be used without a detent mechanism, the preferred embodiment illustrates this combination. The detent mechanism is made up of a first set of detent holding apertures or means 80 which are positioned near or within the interior end of the locking section 56 of the hub member and further includes a second detent holding pin or means 81 positioned at the outer surface of the guide shaft at an axial location corresponding to the location of the first detent holding apertures 80 when the shaft is in the extended position as shown in FIG. 4. The plurality of first detent holding apertures 80 are positioned around the perifery as separated distances corresponding to various ladder positions of the first and second hinge members. The second detent holding pin comprises a spring-biased detent member 81 equal to or smaller in size than the aperture or recess 80 and being mounted within the guide shaft with biasing means so as to be biased against the guide shaft and displaceable within and without the detent recess 80 when the recess and detent member are in common radial alignment. Accordingly, the disclosed axial detent structure enables the guide shaft to be partially extended at any of the ladder positions corresponding to each of the detent apertures 80 by depression of the release mechanism 44. As the retracted guide shaft is extended along longitudinal axis 50, the detent pin 81 engages the detent appurture 80 and is temporarily restrained from returning to its retracted position, despite the bias force which is applied through the spring 43. As the hinge is rotated, the detent pin disengages from the detent appurture 80, but the locking pins encounter the misaligned hinge plate 14 which retains the non-locking configuration until the next alignment of locking apertures 24–27 is encountered. It will be apparent that other detent structures might be used, such as channels in place of the openings illustrated in the figures.

Accordingly, the present depressable release mechanism offers optional adaptability to either (i) a detent controlled release mechanism or (ii) a non-detent mechanism. The simplicity of the depressable release mechanism over prior pull-type mechanisms contributes to not only to convenience of operation, but to cost savings as well. Therefore, the present invention enables the manufacture of an adjustable ladder which is more simple to use, is better adapted for versatile applications and is less expensive to manufacture. The present invention achieves these advantages with structural components which do not require extensive machining, but are well suited for inexpensive manufacturing procedures. Finally, the structure offers greater advantage by providing for increased size of the biasing spring for improved safety and wear.

It will be apparent to those skilled in the art that the disclosed structure is only one embodiment and that variations are forseeable. For example, other geometric shapes and sizes are possible, depending upon the type of ladder to be attached. Note also that additional safety features are envisioned, such as locking pin 85 which is journaled between hinge members 12*a–b* and 12*c–d*. This pin provides a safety block restraining further rotation of the hinge members beyond the extreme position shown in FIG. 1. Accordingly, the scope of the invention is to be ascertained from the claims and is not to be limited to the embodiment disclosed.

I claim:

1. An improved hinge and release mechanism for collapsible ladders, said hinge being of the type wherein first and second members each have a head portion and a ladder stringer-engaging portion, the first and second members being pivotally engaged for rotation about a pivotal axis extending generally perpendicularly through a circular pivot aperture in said head portions and having respective first locking apertures which are at radially spaced positions from the pivotal axis and can be selectively aligned or misaligned by mutual rotation of said first and second members about the pivotal axis, and at least one locking pin which is selectively inserted through the locking apertures, when aligned, to adjust the hinge from an unlocked to a locked position, thereby preventing mutual rotation of the first and second members, the improved hinge further comprising:

(a) a tubular hub member having an inner diameter slightly smaller than a diameter of the pivot aperture in the head portions of the first and second members and adapted for being journalled therein, said tubular hub member one end being a locking end, and the other opposite being an unlocking end, and a longitudinal axis corresponding to the pivotal axis, and further having an opening therethrough which forms a guide aperture about the longitudinal axis;

(b) a guide shaft disposed in the hub member for both (i) axially slidable translation between extended and retracted positions with respect to the locking end of the hub member and along the longitudinal axis through the guide aperture, and (ii) rotation within the guide aperture about the longitudinal axis;

(c) a handle member disposed completely outside the hub member and being secured to the guide shaft adjacent the unlocking end of the hub member and extending outwardly from the longitudinal axis approximately to the radially spaced position of the first locking apertures, said locking pin being secured to the handle member and being oriented in mating relationship with respect to the first locking apertures when in common alignment;

(d) bias means for applying an axial biasing force to the guide shaft to urge the guide shaft toward the retracted position wherein the aligned locking pin and locking apertures are in a locked and mated configuration;

(e) a hinge release mechanism comprising:

(1) a release plate having a contact side and an opposing operating side with a plate diameter exceeding the inner diameter of the tubular hub member, said contact side being adapted for depression toward the hub member;

(2) a first annular flange having an axial length projecting toward the hub member from the operating side of the plate and having a tubular cross-sectional configuration which is characterized by an inner tubular diameter which is slightly larger than the outer diameter of the hub member;

(3) a second annular flange having an axial length substantially equal to the axial length of the first annular flange projecting toward the hub member from the operating side of the plate and having a tubular cross-sectional configuration which is characterized by an outside tubular diameter which is slightly smaller than the inside diameter of the hub member, such that in combination with the first annular flange, said second annular flange forms an annular channel such that said hub member can telescopically mate within the annular channel when the guide shaft is in the partially extended position, whereby the hub is held within said annular channel and lateral movement of the hub is prevented;

(4) means for coupling the guide shaft in fixed rotational attachment to the release plate at a central portion thereof and within an area enclosed by the annular flanges;

(f) means for housing said bias means in direct physical contact between the hinge release mechanism and the locking end of the tubular hub member, and (g) retaining means for holding the first and second members in a juxtaposed position at a fixed location along the longitudinal axis and mounted on the periphery of the hub member wherein the means for coupling the guide shaft and release plate in fixed rotational attachment comprises a second shaft, said second shaft and said second annular flange including means for attachment, said means for attachment comprising a radial bore in the second annular flange and the second shaft, respectively, having common alignment and being sized to fit a locking pin which comprises part of the coupling means and which is inserted into the bore to lock the shaft and release plate in fixed axial rotation; said second flange encloses a locking recess adapted to receive the second shaft and including a bore aligned with the bore of the first flange and extending diametrically through both sides of second flange to enable insertion of said locking pin through the first flange and into the two respective bore openings of the second flange and the bore of the second shaft.

2. A hinge as defined in claim 1, further comprising axial detent means operable against the guide shaft to partially restrain the shaft from its said retracted position and in said extended position with respect to the locking end of the hub member and in opposition to the biasing force while permitting rotation of the guide shaft within the guide aperture.

3. A hinge as defined in claim 2 wherein the detent means comprises first detent holding means positioned near and within an interior section of the unlocking end of the hub member, and being operable in combination with a second detent holding means positioned at an outer surface of the guide shaft at an axial location corresponding to the location of the first detent holding means when the shaft is in the extended position.

4. A hinge as defined in claim 3 further comprising a plurality of first detent holding means positioned around the periphery at the axial location and at separated distances corresponding to various relative ladder positions of the first and second members.

5. A hinge as defined in claim 4 wherein the first detent holding means comprises a recess within an inner surface of the hub member and said second detent holding means comprises a spring biased detent member no greater in size than the recess and being mounted in the guide shaft with means so as to be biased against the guide shaft and displaceable within and without the detent recess when the recess and detent member are in common radial alignment.

6. A hinge as defined in claim 1, wherein the tubular hub member has a uniform inner diameter and comprises a locking section extending axially inward from the locking end and an unlocking section extending axially inward from the unlocking end, said two sections being defined with respect to the journalled guide shaft in the extended position wherein the respective sections terminate at a central position along the hub corresponding to the axial location of the unlocking end within the hub.

7. A hinge as defined in claim 1 wherein the second shaft being of lesser diameter than the guide shaft and being formed integrally therewith along a common central axis.

8. A hinge as defined in claim 7 wherein the guide shaft is approximately equal in axial length to the hub member and wherein the second shaft is approximately equal in length to the axial length of the annular flanges.

9. A hinge as defined in claim 1, wherein the bias means comprises a helical spring positioned within the annular channel of the hinge release mechanism.

* * * * *

UNITED STATES PATENT AND TRADEMARK OFFICE

CERTIFICATE OF CORRECTION

PATENT NO. : 4,697,305

DATED : October 6, 1987

INVENTOR(S) : Lee H. Boothe

It is certified that error appears in the above-identified patent and that said Letters Patent is hereby corrected as shown below:

Col. 2, line 29, "collapsable" should be --collapsible--.

Col. 4, line 1, "stringer" should be --stringers--.

Col. 6, line 5, "axially" should be --axial--.

Col. 7, line 39, "as separated" should be --at separated--.

Col. 7, line 57, "appurture" should be --aperture--.

Col. 7, line 68, "contributes to not" should be --contributes not--.

Col. 8, line 42, "a diameter" should be --the diameter--.

Col. 10, line 46, "being" should be --is--.

Col. 10, line 47, "being" should be --is--.

Signed and Sealed this

Seventh Day of June, 1988

*Attest:*

DONALD J. QUIGG

*Attesting Officer*

*Commissioner of Patents and Trademarks*